US005133252A

United States Patent [19]

Replogle

[11] Patent Number: 5,133,252

[45] Date of Patent: Jul. 28, 1992

[54] ALUMINUM CAN CRUSHING APPARATUS

[76] Inventor: Lawrence C. Replogle, 5325 Norfolk Ct., Gurneern Woods, Ill. 60031

[21] Appl. No.: 629,156

[22] Filed: Dec. 18, 1990

[51] Int. Cl.[5] ..... B30B 15/06

[52] U.S. Cl. ..... 100/295; 100/902

[58] Field of Search ..... 100/902, 218, 226, 295; 99/349; 15/104 R, 210 R

[56] References Cited

U.S. PATENT DOCUMENTS

| | | | |
|---|---|---|---|
| 587,083 | 7/1897 | Thomson | 100/295 X |
| 1,065,638 | 6/1913 | Thelen | 100/295 |
| 1,998,263 | 4/1935 | Townsend | 100/902 X |
| 2,514,334 | 7/1950 | Niedermeyer | 100/295 X |
| 2,554,734 | 5/1951 | Gehm | 100/295 X |
| 3,280,662 | 10/1966 | Frankenfield | 100/295 X |
| 4,416,197 | 11/1983 | Kehl | 100/295 X |
| 4,538,459 | 9/1985 | Vandenbergh | 100/902 X |
| 4,606,266 | 8/1986 | Hyman, Sr. | 100/902 X |
| 4,682,539 | 7/1987 | Bramblett et al. | 100/902 X |
| 4,696,227 | 9/1987 | Van Buskirk | 100/902 X |
| 4,813,091 | 3/1989 | Glasener | 15/160 |
| 4,890,552 | 1/1990 | Yelczyn | 100/902 X |
| 4,912,801 | 4/1990 | Hammill | 15/160 |
| 4,951,344 | 8/1990 | Alkhato | 5/210 R X |
| 5,033,375 | 7/1991 | Reeves | 100/902 X |

FOREIGN PATENT DOCUMENTS

| | | | |
|---|---|---|---|
| 59-47096 | 3/1984 | Japan | 100/902 |
| 1156139 | 6/1969 | United Kingdom | 100/902 |

*Primary Examiner*—Harvey C. Hornsby
*Assistant Examiner*—Stephen F. Gerrity
*Attorney, Agent, or Firm*—Rosenthal & Putterman

[57] ABSTRACT

A manually operated aluminum can crushing apparatus is disclosed. The apparatus comprises an upper surface and a lower surface. A centrally located upwardly extending protuberance is disclosed and defines a cavity in the lower surface of the apparatus. First and second alignment means are provided that are adapted to contactingly receive an aluminum can to be crushed and to align the same perpendicular to the axis of the applied crushing force. Optional handles and gripping surfaces may be provided.

10 Claims, 4 Drawing Sheets

ALUMINUM CAN CRUSHING APPARATUS

This invention relates generally to the field of can crushing devices and more particularly, to aluminum can crushers used in connection with recycling.

BACKGROUND OF THE INVENTION

Can crushers are known. However, the recent rise in recycling, due to both environmental concern as well as local legislation, has caused a proliferation of these devices. While generally satisfying their intended purpose, they are not without their inherent drawbacks and limitations.

For example, U.S. Pat. No. 4,606,266 discloses a combination can crushing apparatus and exercise apparatus that includes an elongate base with one end configured to hold a can in position and a movable jaw pivotally mounted at the opposite end. A spring mechanism is provided to urge the jaw away from the base. To operate the apparatus, a can is placed in the can holding end. The foot of the user is then used to urge the free end of the jaw toward the can to apply the pressure necessary to collapse it. While effective, this device is not easily cleaned when soiled as it is susceptible to rust, and joints between moving parts must be lubricated.

A wall mounted can crusher is disclosed in U.S. Pat. No. 4,890,552 to Yelczyn. The can crusher is adapted to be mounted on a wall (preferably vertical) and includes a base for supporting a can. A handle is connected to a top plate which is positioned at a level above where the top of the can is located. When the lever is pulled, the top plate is urged downward on to the can thereby crushing the same. This too, while effective, is deficient in that it is relatively large, must be permanently mounted to a wall, is difficult to clean, and moving parts must be lubricated and maintained.

In view of the foregoing drawbacks and deficiencies, it is an object of the present invention to provide a can crushing apparatus that is maintenance free.

Another object of the invention is to provide a can crushing device that is portable, lightweight and easily cleanable.

Yet another object of the invention is to provide a can crushing device that is simple and easy to use.

SUMMARY OF THE INVENTION

These and other objects are accomplished by providing a manually operated aluminum beverage can crushing device including a compression disk having upper and lower surfaces. The upper surface includes a centrally positioned protuberance that defines a corresponding cavity in the lower surface. An alignment groove for centrally aligning a can to be collapsed beneath the compression disk is operatively associated with the lower surface of the disk. Also, a handle may be included that is connected to the upper surface to assist in gripping the device. Thus, when a can is placed beneath the compression disk so that its periphery is centered beneath the alignment groove and downward pressure is exerted, the can collapses easily and safely.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENTS

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention. Furthermore, while specific reference is made to an aluminum can crushing device, it will be understood that the present invention may be used to collapse many types of containers as well as those of different materials such as tin, plastic, paper, etc.

Figure 1:
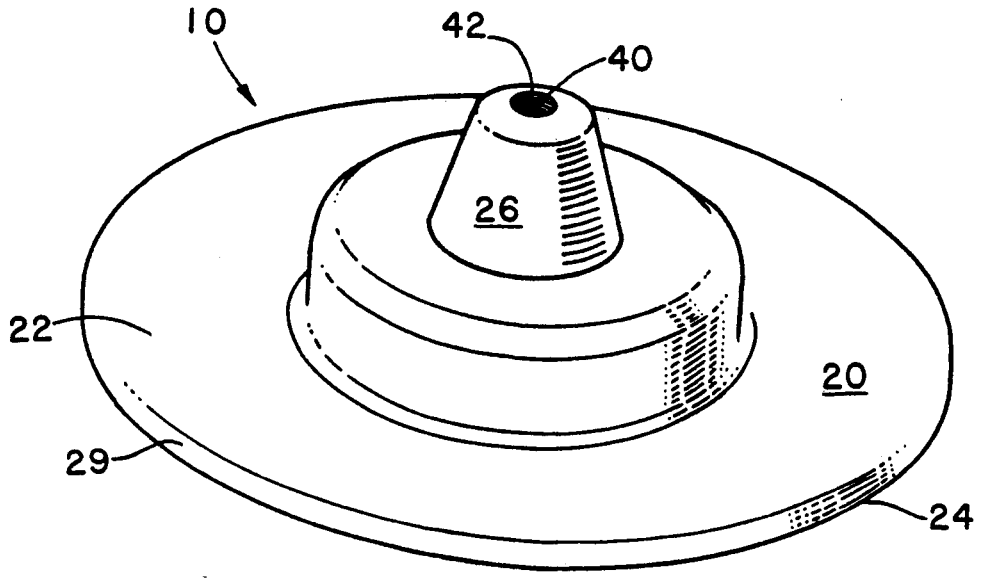
FIG. 1 is a perspective view a first embodiment of the can crushing apparatus according to the present invention.
Figure 2:
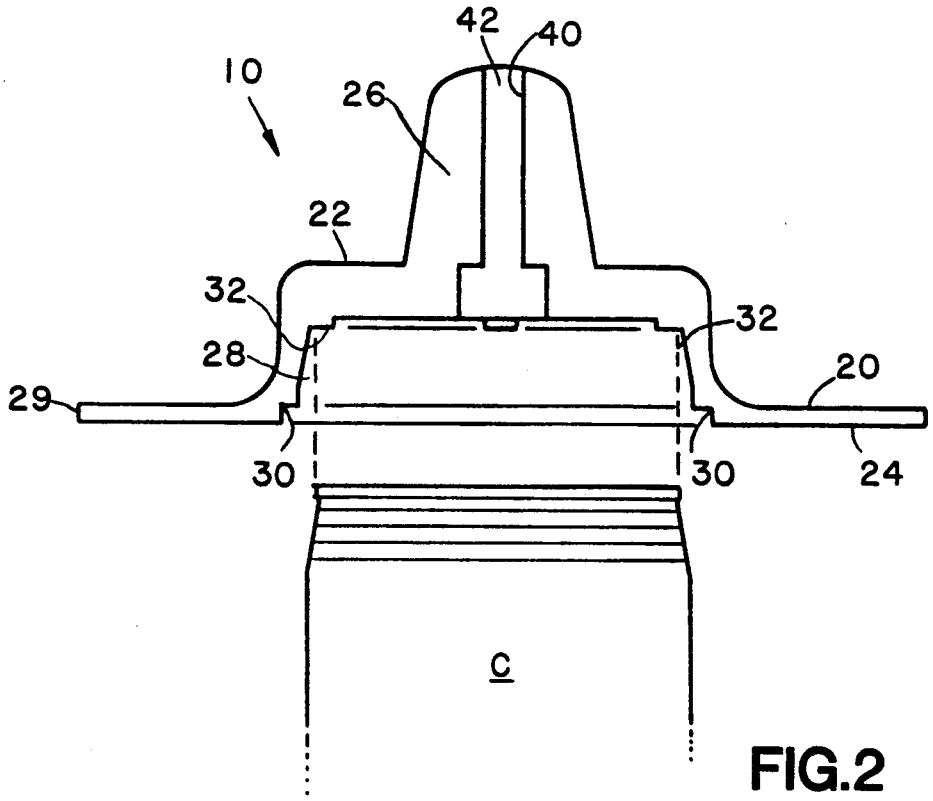
FIG. 2 is a cross-sectional view of a first embodiment of the can crushing apparatus according to the present invention.
Figure 3:
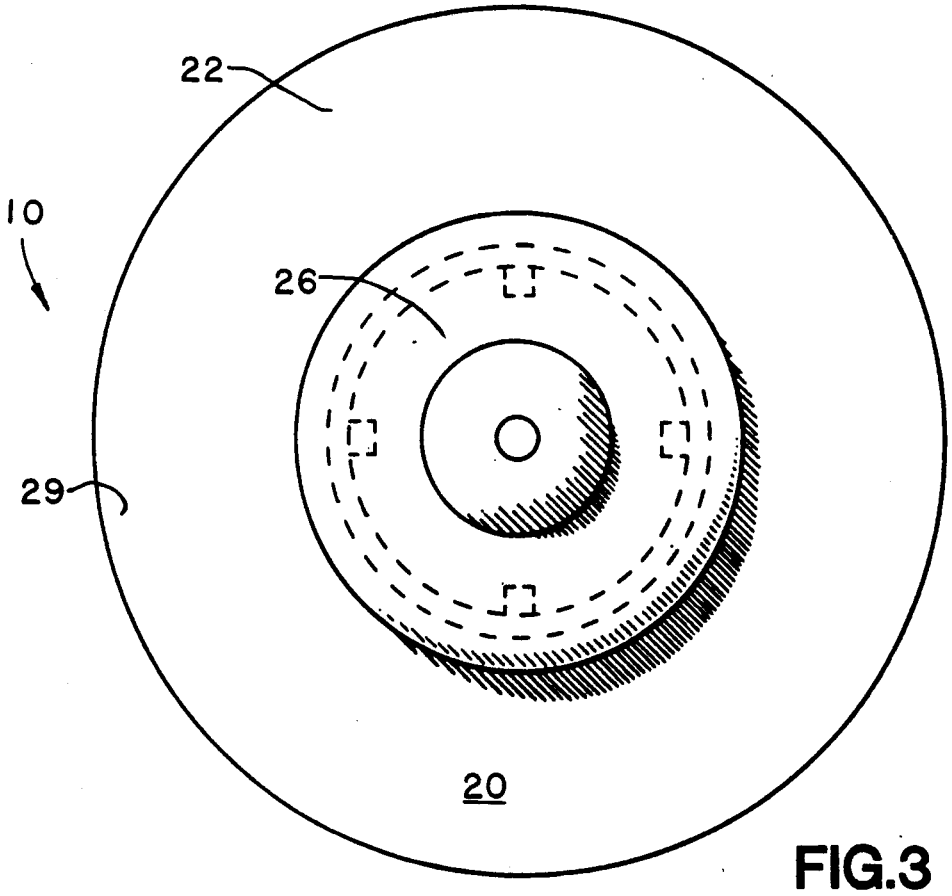
FIG. 3 is a plan view of a first embodiment of the can crushing apparatus according to the present invention.

Referring now to the drawings and more particularly to FIGS. 1 through 3, a first embodiment of the aluminum can crushing apparatus of the present invention is there illustrated. The apparatus, generally indicated at 10 comprises a generally circular compression means 20 which includes an upper surface 22 which is substantially flat and a lower surface 24 which is also substantially flat. The upper surface includes an upwardly extending protuberance 24 defining a corresponding cavity 28 in the lower surface 24 of the apparatus. The cavity 28 is shaped so as to substantially mirror the upper portion of an aluminum beverage can so that a can C may be contactingly inserted therein. A substantially flat region or annulus 29 extends about one-half a can width around the protuberance to protect the hand of the user from sharp edges which may be created when a can is crushed.

Figure 5:
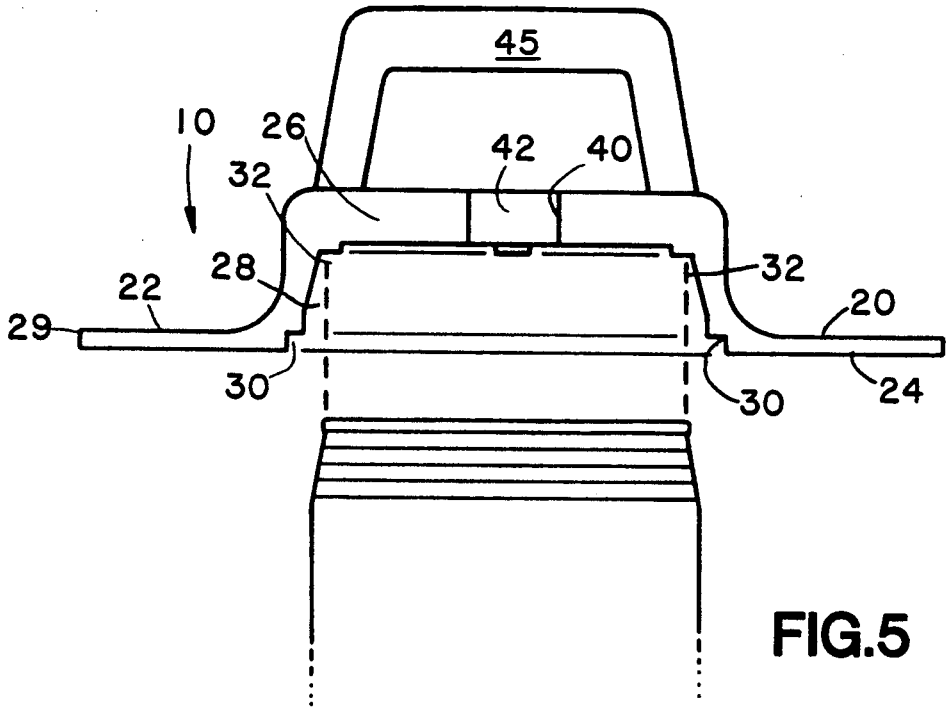
FIG. 5 is a cross-sectional view of a second embodiment of the can crushing apparatus of the present invention.

An alignment means 30 for centrally aligning a can C having a first diameter to be crushed beneath the compression means 20 is operatively associated with the lower surface 24. In the illustrated embodiment, the alignment means 30 comprises an annular recess or groove in the lower side of the apparatus. The groove 30 is symmetrically positioned beneath the protuberance proximate the junction between the flat lower surface and the beginning of the cavity 28. The diameter of the groove 30 substantially matches the diameter of the top lip of the beverage can which is adapted to receive (as best shown in FIGS. 2 and 5).

Also, as illustrated, a second alignment means 32 to accommodate beverage cans of a second diameter may be provided proximate the upper portion of the cavity. The second alignment means 32 takes the form of a plurality of downwardly extending projections which are equally spaced apart, such as at 90 degree intervals, as illustrated. It will be noted, however, that the second alignment means could also take alternate forms such as a groove adapted to receive the upper lip of the beverage can to be crushed, etc.

The can crushing apparatus 10 also includes a release means 40 for separating a crushed aluminum can C from the compression means 20. More specifically, the release means 40 comprises a hole in the upper surface of the compression means defining an opening 42 proximate the portion of the compression means that overlies the aluminum can. This opening communicates with the cavity portion lower surface and can be employed to assist in the removal of a crushed can which is stuck in the compression means, as will be discussed in greater detail hereinbelow.

Figure 7:
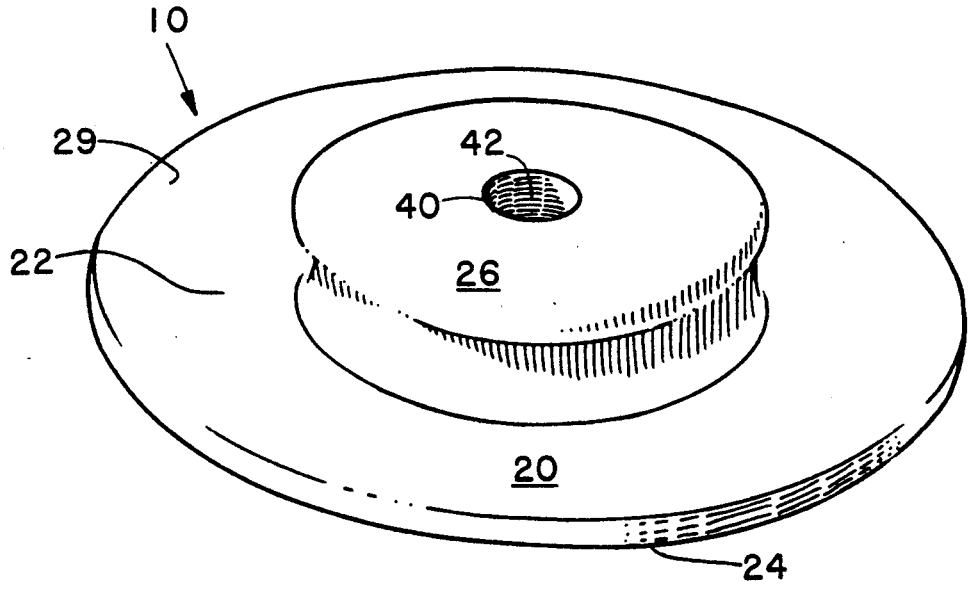
FIG. 7 is a perspective view of a third embodiment of the can crushing apparatus of the present invention.
Figure 4:
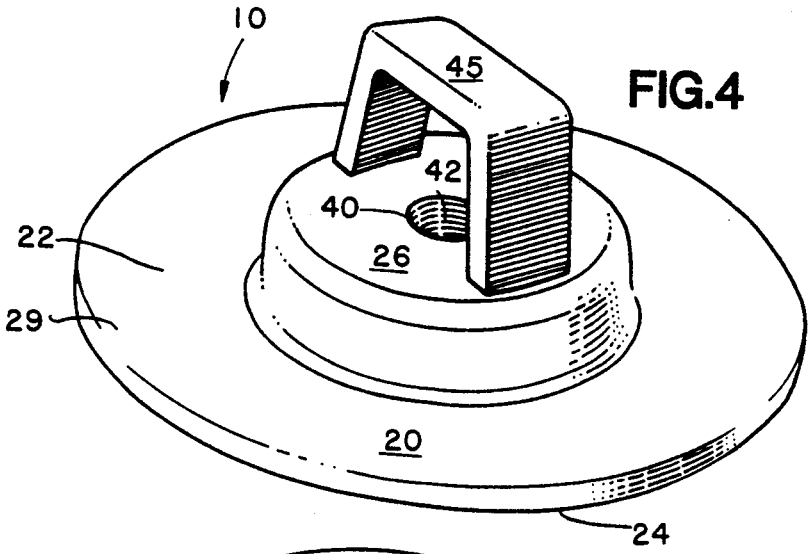
FIG. 4 is a perspective view of a second embodiment of the can crushing apparatus of the present invention.
Figure 9:
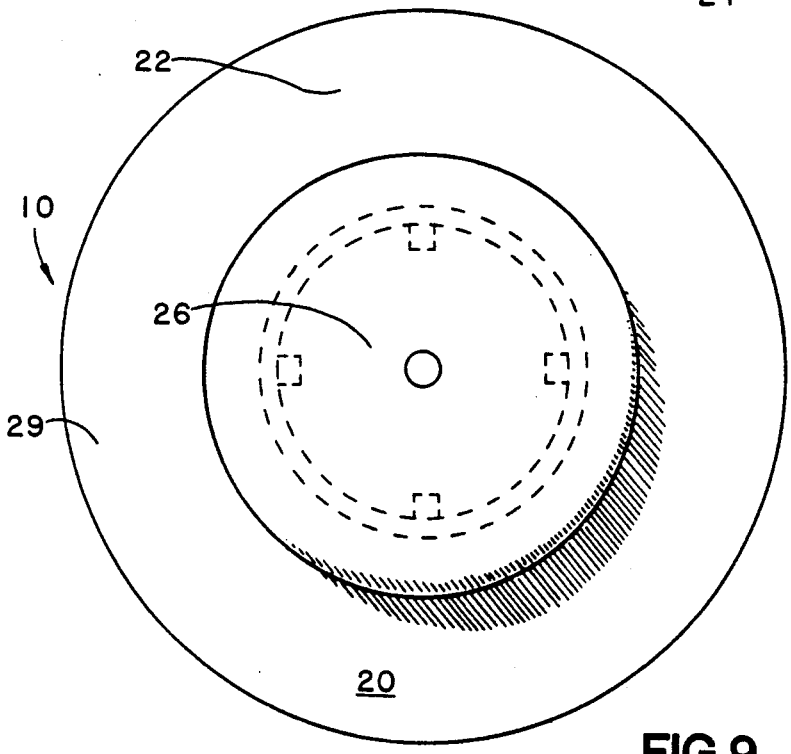
FIG. 9 is a plan view of a third embodiment of the can crushing apparatus of the present invention.
Figure 8:
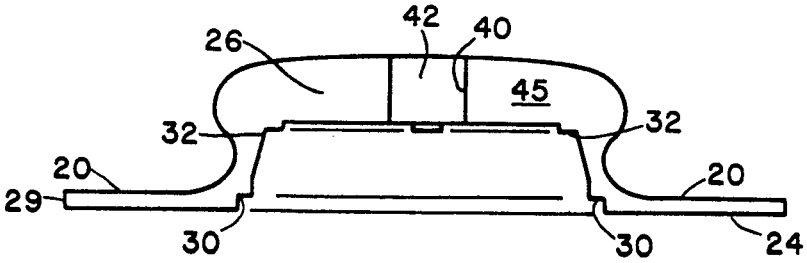
FIG. 8 is a cross-sectional view of a third embodiment of the can crushing apparatus of the present invention.
Figure 6:
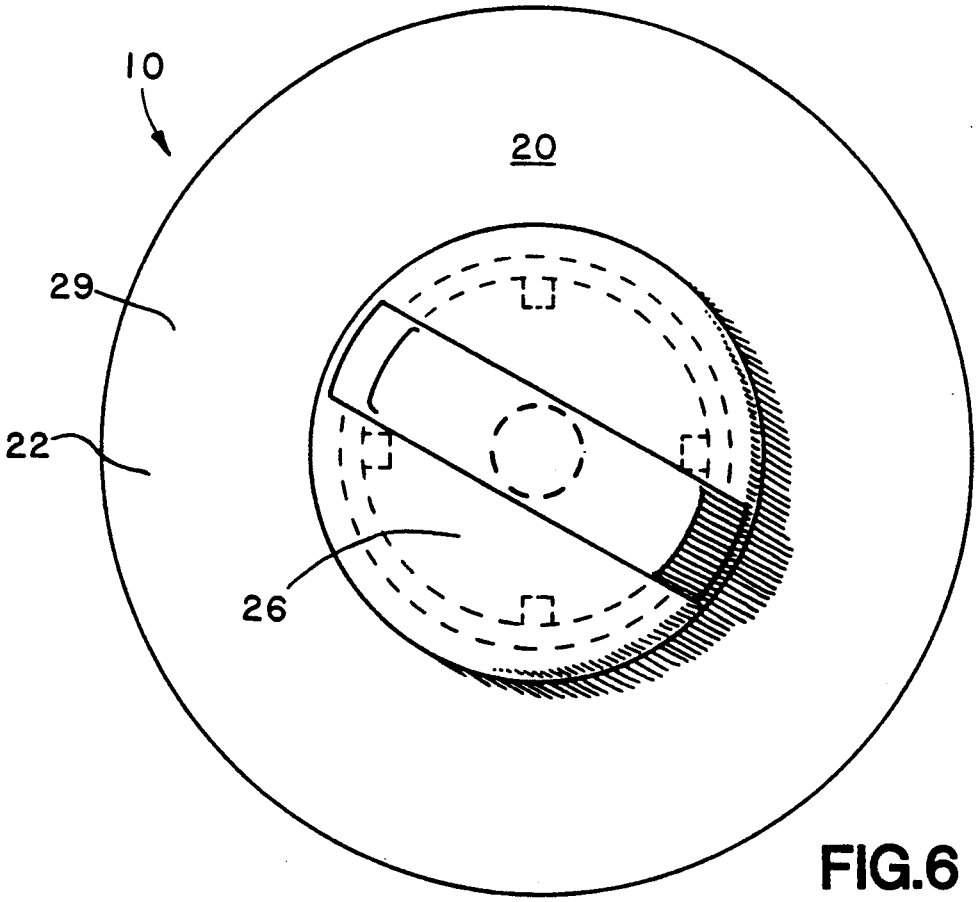
FIG. 6 is a plan view of a second embodiment of the can crushing apparatus of the present invention.

The crushing apparatus also includes a gripping means or handle 45. In the first embodiment (FIGS. 1-3) the protuberance can be gripped by the hand of the user. In the second embodiment (FIGS. 4-6), there is provided a handle 45 which is generally U-shaped, the opposing ends of which are connected to the upper surface of the compression means 20. While the illustrated handle 45 is connected to the protuberance 26, it can be connected to the flat portion of the crushing apparatus with equal efficacy. In the third embodiment (FIGS. 7-9), the handle 45 is substantially similar to a conventional handle as is present for lifting the lids of pots.

It is contemplated that the compression means 20 be molded from a lightweight, relatively strong, non-corroding, metal (such as an aluminum based alloy) or a suitable plastic, well known to those skilled in the art.

When it is desired to use the apparatus 10 to crush an aluminum can C, the upper edge of the can C is placed in contact with the appropriate alignment means 30 or 32 and the bottom of the can C is placed on a rigid surface such as the floor. The user then grips the gripping means 45 (or the protuberance) and exerts a downward pressure perpendicular to the longitudinal axis of the can C. This causes the can to collapse, thus crushing the can and causing its volume to be reduced for storage prior to recycling. In addition, should the can be difficult to remove from the crusher, a rod or screwdriver can be inserted in the release means 42 to assist in separating the can C from the crusher 10.

The foregoing embodiments and examples are to be considered illustrative, rather than restrictive of the invention, and those modifications which come within the meaning and range of equivalence of the claims are to be included therein.

That which is claimed is:

1. A manually operated aluminum beverage can crushing device comprising:

a compression means having an upper surface and a lower surface, said upper surface including a centrally positioned upward extension protuberance defining a corresponding cavity in said lower surface, said compression means further including a solid, flat, planar annulus approximately one-half can width in diameter extending outwardly from said cavity, said annulus being parallel to the lower surface of said compression means, a release means for separating a crushed can from said compression means in the form of a bore defining a channel that permits air flow between the cavity and the upper surface, a gripping means associated with the upper surface of said compression means, and an alignment means for centrally aligning a can to be crushed beneath said compression means operatively associated with said lower surface, said alignment means comprising an annular recess in the lower surface of said compression means substantially underlying said protuberance and being adapted to contactingly receive at least a portion of the upper peripheral edge of a beverage can, whereby when an aluminum can is placed beneath the compression means so that its periphery is centered beneath the alignment means and downward pressure is exerted, the can collapses easily and safely.

2. The manually operated aluminum beverage can crushing device according to claim 1 wherein said gripping means comprises a generally U-shaped handle, the opposing ends of which are connected to the upper surface of said compression means.

3. The manually operated aluminum beverage can crushing device according to claim 1 wherein said bore comprises a hole in the upper surface of said crusher defining an opening proximate the portion of said compression means that overlies the aluminum can, said opening communicating with the lower surface of said compression means.

4. The manually operated aluminum beverage can crushing device according to claim 1 wherein said alignment means comprises a plurality of spaced apart projections positioned within said cavity and adapted to contactingly receive at least a portion of the upper peripheral edge of a beverage can to be crushed.

5. The manually operated aluminum beverage can crushing device according to claim 1 wherein said cavity shape substantially mirrors the shape of the upper portion of the can so that the can may be contactingly inserted therein.

6. A manually operated aluminum beverage can crushing device comprising:

a compression means having an upper surface and a lower surface, said upper surface including a centrally positioned upwardly extending protuberance defining a corresponding cavity in said lower surface, an alignment means for centrally aligning a can of a first diameter to be crushed beneath said compression means operatively associated with said lower surface, second alignment means for centrally aligning a can of a second diameter to be crushed beneath said compression means operatively associated with said lower surface, whereby when an aluminum can is placed beneath the compression means so that its periphery is centered beneath one of the respective alignment means and downward pressure is exerted, the can collapses easily and safely.

7. The manually operated aluminum beverage crushing device according to claim 6 further including a gripping means associated with the upper surface of said compression means.

8. The manually operated aluminum beverage can crushing device according to claim 6 wherein said gripping means comprises a generally U-shaped handle, the opposing ends of which are connected to the upper surface of said compression means.

9. The manually operated aluminum beverage can crushing device according to claim 8 further including release means for separating a crushed aluminum can from said compression means.

10. The manually operated aluminum beverage can crushing device according to claim 9 wherein said release means comprises a hole in the upper surface of said compression means defining an opening proximate the portion of said compression means that overlies the aluminum can, said opening communicating with the lower surface of said compression means.

* * * * *